United States Patent [19]

Steeves et al.

[11] 4,300,980

[45] Nov. 17, 1981

[54] OVERLAPPING DOUBLE ETCH TECHNIQUE FOR EVALUATION OF METALLIC ALLOYS TO STRESS CORROSION CRACKING

[75] Inventors: Arthur F. Steeves, Schenectady; James C. Stewart, Loudonville, both of N.Y.

[73] Assignee: The United States of America as represented by the United States Department of Energy, Washington, D.C.

[21] Appl. No.: 154,172

[22] Filed: May 28, 1980

[51] Int. Cl.[3] ..... C23F 1/02

[52] U.S. Cl. ..... 156/626; 156/651; 156/656; 156/661.1; 156/664; 252/79.2

[58] Field of Search ..... 156/626, 651, 656, 661.1, 156/664; 252/79.2, 79.4

[56] References Cited

U.S. PATENT DOCUMENTS

| | | | |
|---|---|---|---|
| 2,888,335 | 5/1959 | Atkins et al. | 156/664 X |
| 3,709,824 | 1/1973 | Oda et al. | 156/664 X |
| 3,758,351 | 9/1973 | Striedieck et al. | 156/664 X |
| 3,985,596 | 10/1976 | Steingroever | 156/664 |

OTHER PUBLICATIONS

Metallography 9, No. 2, Improved Metallographic Etching Techniques for Stainless Steel and for Stainless Steel to Carbon Steel Weldments, Apr., 1976, F. C. Bell et al. pp. 91–107.

*Primary Examiner*—William A. Powell

*Attorney, Agent, or Firm*—Michael F. Esposito; Richard G. Besha; James E. Denny

[57] ABSTRACT

A double overlapping etch zone technique for evaluation of the resistance of metallic alloys to stress corrosion cracking. The technique involves evaluating the metallic alloy along the line of demarcation between an overlapping double etch zone and single etch zone formed on the metallic alloy surface.

8 Claims, 6 Drawing Figures

Fig. 1
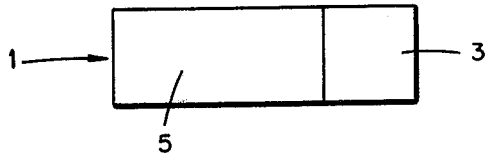
Fig. 1a
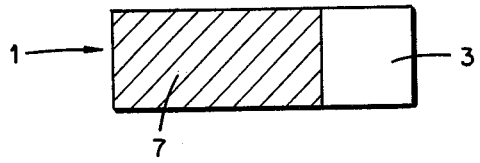
Fig. 1b
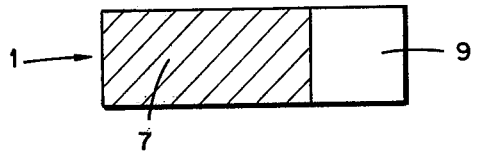
Fig. 1c
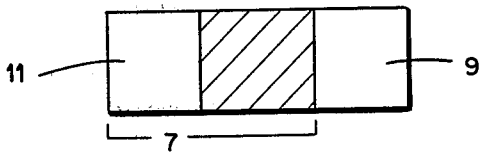
Fig. 1d
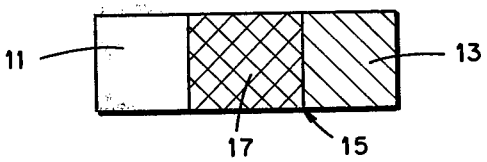
Fig. 1e
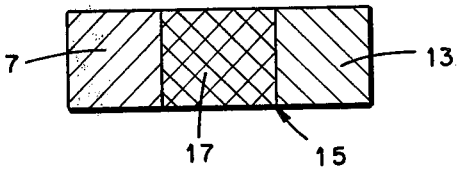
Fig. 1f

OVERLAPPING DOUBLE ETCH TECHNIQUE FOR EVALUATION OF METALLIC ALLOYS TO STRESS CORROSION CRACKING

The U.S. Government has rights in this invention pursuant to Contract No. EY-76-C-12-0052 between the U.S. Department of Energy and General Electric.

BACKGROUND OF THE INVENTION

The present invention relates to the evaluation of metallic alloys for resistance to stress corrosion cracking. In particular, the present invention is concerned with the evaluation of NiCrFe alloys for resistance to stress corrosion cracking in deaerated primary water (i.e. low oxygen content water used in nuclear reactors).

The problem of stress corrosion cracking of metallic alloys, particularly NiCrFe alloys, during use in deaerated primary water has existed for quite some time. Evaluation procedures for testing these alloys to determine their suitability for use in this particular environment have been developed. These known evaluation procedures are based upon the observation that alloys which do possess adequate resistance to stress corrosion cracking in deaerated primary water have carbides precipitated primarily in their grain boundaries. These carbide deposits are formed during the actual production of the alloys.

In previous work the evaluation of the NiCrFe alloys involved complicated metallographic procedures. A typical procedure comprises grinding and polishing the alloys followed by etching the alloy with nital. The nital etch is used to determine the grain boundary locations. The alloy is marked to identify the microscopic area and a photomicrograph of the area at high magnification (e.g. 500x) is taken. Subsequently, the alloy is reground and repolished to eliminate the effects of the nital etchant. The refinished alloy is re-etched with phosphoric acid to determine the location of the carbide precipitates. A photomicrograph at 500x establishes these locations. Finally, the two photomicrographs are compared to determine the continuity and location of the carbide precipitate enabling the investigator to predict the resistance of the tested alloy to stress corrosion cracking in deaerated primary water. The problems with this procedure are evident. It is not only long and difficult, but evaluation is limited to extremely minute areas (i.e. $8\times10^{-5}/in^2$ for a $4\times5$ inch photomicrograph). Accordingly, it is often necessary to examine several different locations to ensure proper evaluation. This, of course, necessitates duplicating the above described procedure, increasing the time required for complete evaluation.

A number of unsuccessful attempts have been made to improve the above described procedure. For example, attempts have been made to use a single etch which attacks the carbides. However, this procedure left doubt as to the location of the grain boundaries. Conversely, if the grain boundaries are delineated by a single etch, the location of the carbide precipitate becomes a problem. Accordingly, development of a relatively uncomplicated and accurate evaluation procedure has remained a problem because of the necessity of including two etching techniques.

SUMMARY OF THE INVENTION

It is the primary object of the present invention to provide a novel and accurate overlapping etch technique for evaluation of metallic alloys for resistance to stress corrosion cracking.

It is a further object of the present invention to provide a novel and accurate overlapping etch technique for evaluation of NiCrFe alloys for resistance to stress corrosion cracking.

It is a still further object of the present invention to provide a novel and accurate overlapping etch technique for evaluation of metallic alloys for resistance to stress corrosion cracking in deaerated primary water.

It is another object of the present invention to provide a novel and accurate overlapping etch technique for evaluation of NiCrFe alloys for resistance to stress corrosion cracking in deaerated primary water.

It is another object of the present invention to provide a novel and accurate overlapping etch and photomicrograph technique for evaluating a metallic alloy for resistance to stress corrosion cracking.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention as embodied and broadly described herein, the process of this invention may comprise applying an etch resistant masking material to a preselected area of a metallic alloy substrate leaving another area on said substrate uncoated. The uncoated area is etched with a material suitable to delineate the grain boundaries on the substrate. The etch resistant masking material is removed producing a metallic alloy substrate possessing etched and non-etched surface areas. A second etch resistant mask is applied to only preselected portions of the etched surface areas. The remaining uncoated portions of said etched surface areas are juxtaposed with the uncoated non-etched surface area. The uncoated areas are etched with a material suitable to determine the locations of the carbide deposits on the substrate surface. This second etching procedure establishes an overlapping double etch zone and a single etch zone on the substrate surface. Optionally, the second etch resistant mask may be removed from the substrate. Finally, the substrate is evaluated for resistance to stress corrosion cracking along the line of demarcation established between the overlapping double etch zone and the single etch zone formed by the second etching procedure.

It should be noted that the application of the second etch resistance masking material is merely preferred, and may be eliminated because the evaluation takes place along the line of demarcation established between the overlapping double etch zone and the single etch zone established by the second etching. The application of the second etch resistance masking material is preferred because it protects the substrate from unnecessary etching, which can affect the results of subsequent test procedures unrelated to stress corrosion cracking, and may also provide an area etched only with the first etchout for reference or evaluation purposes.

Preferably, the metallic alloy substrate includes FeCrNi, and the masking material is a rubber cement.

In another preferred embodiment the etchant used to delineate grain boundaries includes nital, and the etchant used to establish the location of the carbide precipitates includes phosphoric acid.

In a further preferred embodiment the evaluation procedure includes taking a photomicrograph of the substrate encompassing the juxtaposed overlapping double etch zone and the single etch zone formed during the second etching step and examining the photomicrograph along the line of demarcation (i.e. evaluation line) to determine the location of the carbide precipitates.

The general advantages of the overlapping etch evaluation technique of the present invention compared to the previously discussed evaluation techniques resides in a shorter preparation time for the alloy surface being tested and the accuracy and ease by which the evaluation can be made. In particular, the advantages of the present invention can be summarized as including:

(1) repreparation of the substrate is eliminated (i.e. no regrinding and repolishing of the substrate between etching treatments),
(2) elimination of the identification of the microscopic area,
(3) only one photomicrograph is necessary,
(4) evaluation can be obtained over the entire cross section of the sample,
(5) grain boundary delineation is improved facilitating evaluation,
(6) the substrate itself provides a permanent record for easy reference,
(7) the same technique may be employed in both laboratory and field evaluations.

The accompanying drawing (FIGS. 1(*a*)–1(*f*)) which is incorporated in and forms a part of the specification is a schematic illustration of the process of the present invention.

Reference will now be made in detail to the present preferred embodiment of the invention, an example of which is illustrated in the accompanying drawing.

DETAILED DESCRIPTION OF THE INVENTION

The invention will now be described in detail with reference to the schematic illustration of the overlapping etch technique of the present invention set forth in FIG. 1.

Referring to FIG. 1(*a*) the overlapping etch technique of the present invention comprises applying an etch resistant masking layer 3 to a preselected area of substrate 1 leaving area 5 uncoated. The masking layer may comprise any conventional material which is not attacked by the subsequently applied etchant used to delineate the grain boundaries on the substrate. For example, a conventional rubber cement is suitable. Any conventional method of applying masking layer 3 to substrate 1 may be used, such as brushing or spraying.

With reference to FIG. 1(*b*) the masked substrate is etched in uncoated area 5 producing etched surface area 7. The echant may be any material suitable to delineate the grain boundaries on substrate 1. Preferrably, the etchant includes nital (i.e. 95% alcohol and 5% nitric acid).

FIG. 1(*c*) illustrates substrate 1 after removal of masking layer 3 providing non-etched surface area 9 and etched surface area 7.

Referring to FIG. 1(*d*) a second etch resistant masking layer 11 is applied to only a preselected portion of etched surface 7. Masking layer 11 may be selected from the same material used for masking layer 3 (i.e. rubber cement) and may be applied by any conventional method (e.g. brushing). The masked substrate is etched with a second etchant suitable to determine the locations of the carbide precipitates. Phosphoric acid is the preferred etchant for this procedure. With reference to FIG. 1(*e*), this second etching step provides a single etch zone 13 in juxtaposition to an overlapping double etch zone 17 and a line of demarcation or evaluation line 15 on the substrate. The evaluation of the substrate for resistance to stress corrosion cracking may now take place along evaluation line 15. Optionally, masking layer 11 may be removed (see FIG. 1(*f*)) prior to evaluation.

The evaluation procedure may comprise any conventional examination technique known in the art. Preferrably, the evaluation comprises taking a photomicrograph of the substrate encompassing the juxtapositioned areas 13 and 17. Examination of the microphotograph along evaluation line 15 enables one to determine the location of the carbide precipitates on substrate 1. As stated previously, carbide precipitates located predominately in the grain boundaries of the substrate are indicative of good stress corrosion cracking resistance, particulary, in a deaerated primary water environment.

The examination of the photomicrograph along evaluation line 15 can locate the carbide deposits because overlapping double etch zone 17 clearly delineates the grain boundaries while single etch zone 13 shows the carbide precipitates. A comparison of both zones along evaluation line 15 allows for a quick and accurate determination with regard to stress corrosion cracking resistance.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for evaluating metallic alloy substrates for resistance to stress corrosion cracking comprising:

(a) applying an etch resistant masking material to a preselected area of said substrate leaving another area of said substrate uncoated,
(b) etching said uncoated area with a material suitable to delineate the grain boundaries on said substrate,
(c) removing the etch resistant masking material thereby obtaining a substrate possessing etched and non-etched surface areas,
(d) etching the uncoated areas with a material suitable to determine the location of the carbide precipitates on said substrate thereby establishing an overlapping double etch zone and a single etch zone, and
(e) evaluating said substrate for resistance to stress corrosion cracking by examining said substrate along the line of demarcation established between the overlapping double etch zone and single etch zone formed during the second etching step.

2. The method of claim 1 comprising applying subsequent to step (c) and prior to step (d) a second etch resistant masking material to only preselected portions of said etched surface area whereby the remaining uncoated portions of said etch surface area are juxtaposed with the uncoated non-etched surface areas.

3. The method of claim 2 wherein said second etch resistant masking material is removed from said surface prior to evaluating.

4. The method of claim 1 wherein the metallic alloy includes FeCrNi.

5. The method of claim 1 wherein the etchant used in step (b) comprises nital.

6. The method claim 1 wherein the etchant used in step (d) comprises phosphoric acid.

7. The method of claim 4 wherein the etchant used in step (d) comprises phosphoric acid.

8. The method of claim 1 wherein the evaluaton of said substrate is accomplished by a photomicrograph procedure comprising taking a photomicrograph of the substrate encompassing the juxtaposed overlapping double etch zone surface area and the single etch zone area, and examining said photomicrograph along the line of demarcation (i.e. evaluation line) to determine the position of the carbide precipitate on the metallic alloy surface.

* * * * *